US005979698A

United States Patent [19]

Deal

[11] Patent Number: 5,979,698

[45] Date of Patent: Nov. 9, 1999

[54] METHOD AND MEANS FOR RECORDING PERIODIC MEDICINAL DOSAGES

[76] Inventor: Richard E. Deal, 614 S. Moore, Algona, Iowa 50511

[21] Appl. No.: 08/799,870

[22] Filed: Feb. 14, 1997

[51] Int. Cl.[6] ..... G07F 11/00

[52] U.S. Cl. ..... 221/2; 206/459.5; 206/534; 221/1; 116/205; 116/306; 116/308; 116/319; 116/321; 116/324

[58] Field of Search ..... 221/1, 2, 4, 5, 221/155; 116/205, 225, 306, 308, 319, 320, 321–4; 206/459.1, 459.5, 534

[56] References Cited

U.S. PATENT DOCUMENTS

| | | | |
|---|---|---|---|
| Re. 34,673 | 7/1994 | Desbiens | 273/269 |
| D. 333,385 | 2/1993 | Schmid | D3/78 |
| 2,831,278 | 4/1958 | Myers | 40/107 |
| 3,099,352 | 7/1963 | Aven | 206/78 |
| 3,308,962 | 3/1967 | Bryant | 211/74 |
| 3,579,883 | 5/1971 | Hayes | 40/107 |
| 3,675,620 | 7/1972 | Baustin | 116/121 |
| 4,365,722 | 12/1982 | Kramer | 206/534 |
| 4,405,045 | 9/1983 | Villa-Real | 206/534 |
| 4,419,016 | 12/1983 | Zoltan | 368/10 |
| 4,466,614 | 8/1984 | Bachman et al. | 273/139 |
| 4,528,933 | 7/1985 | Allen | 206/534 X |
| 4,572,376 | 2/1986 | Wrennall | 206/538 |
| 4,573,580 | 3/1986 | Messer | 206/534 |
| 4,619,457 | 10/1986 | Small | 273/269 |
| 4,660,991 | 4/1987 | Simon | 368/10 |
| 4,712,504 | 12/1987 | Zarley et al. | 116/323 X |
| 4,752,087 | 6/1988 | Weisbach | 283/67 |
| 4,807,757 | 2/1989 | Rappaport et al. | 206/534 X |
| 4,830,407 | 5/1989 | Sadler, Jr. et al. | 283/102 |
| 4,889,238 | 12/1989 | Batchelor | 206/535 |
| 4,905,866 | 3/1990 | Bartell et al. | 221/5 |
| 4,943,090 | 7/1990 | Fienberg | 273/139 |
| 4,951,596 | 8/1990 | Wallace, Jr. | 116/321 |
| 5,011,032 | 4/1991 | Rollman | 116/321 X |
| 5,050,739 | 9/1991 | Hannan et al. | 206/531 |
| 5,169,001 | 12/1992 | Scheibel | 206/425 |
| 5,216,975 | 6/1993 | Bartholomew | 116/324 |
| 5,313,439 | 5/1994 | Albeck | 368/10 |
| 5,356,012 | 10/1994 | Tang et al. | 206/534 |
| 5,386,795 | 2/1995 | Bartholomew | 116/308 |
| 5,433,324 | 7/1995 | Leonard | 206/534 |
| 5,520,307 | 5/1996 | Miller et al. | 221/2 |
| 5,607,078 | 3/1997 | Nordberg et al. | 116/321 X |
| 5,694,882 | 12/1997 | Marshall | 116/319 X |

*Primary Examiner*—Christopher P. Ellis
*Assistant Examiner*—Steven B. McAllister
*Attorney, Agent, or Firm*—Zarley, McKee, Thomte, Vorhees & Seas

[57] ABSTRACT

A medicinal recording device is provided which is placed directly upon a patient's medication container. The device consists of at least one strip having a plurality of indicia on raised or recessed detents. The indicia correspond to days and dosages. The patient slides a tab attached to the strip along the strip to the marked button corresponding to the day the medication is taken and/or the number of the dose taken. The tab engages the strip adjacent the selected indicia to releasably lock the tab in position and to prevent unintended sliding of the tab.

21 Claims, 2 Drawing Sheets

METHOD AND MEANS FOR RECORDING PERIODIC MEDICINAL DOSAGES

FIELD OF THE INVENTION

The present invention relates to record keeping devices, and in particular, a device and method for recording periodic utilization of product dosages.

BACKGROUND OF THE INVENTION

A major problem physicians face when they prescribe a medication for a patient is the patient failing to take his or her medication properly. For instance, the patient may take or use the medication too frequently, not enough, or completely forget to take the medication at all. Pharmacists normally instruct patients on the proper way to take their medications, but often the patient will forget the directions or not understand them adequately to begin with. Patients also simply forget whether they took their medication as prescribed or at the prescribed times. This problem exists for all forms of medication, including pills capsules, tablets, liquids, and other solids. The problem also applies to veterinary medication prescribed for treatment of animals.

Taking medication improperly can lead to a variety of difficulties. Overmedication can result in toxicity or unwanted side effects while undermedication can result in inadequate treatment of the condition for which the medicine was prescribed. In either situation, the consequences may be serious and may even result in death.

One attempt to monitor a patient's medication has involved the use of medication boxes having individual compartments for the days of the week, with the more elaborate boxes having multiple dose compartments for each day for up to four times a day dosing. While such boxes are indicative of whether a dose for a particular day or dosing interval has been taken, they are also inconvenient to the patient since they are often bulky and must be carried around separately from the patient's medication. Also, the patient must remember to dole out the doses of medication into the appropriate boxes each week prior to the time that the dose must be taken.

Secondly, another means used to keep track of medication is an alarm device which alerts the patient as to when the next dose of medication is due. Some of these methods include the use of specific medication alarms, beepers, and watch alarms. The disadvantages of these devices include the fact that the patient may forget to set the alarm or the device may fail to function due to dead batteries, etc. Further, these types of devices do not work well for patients who have difficulty hearing as is often the case with older patients, and may be difficult to hear if the patient is in a noisy area.

Another method of monitoring medication includes a recording device comprising a container for holding prescription bottles having an indicia area comprising a grid on the outside of the container, with the days of the week on one axis of the grid and the dose and times on the opposite axis, for keeping a record of the times at which medicinal dosages are taken using buttons or markers. This method, however, is also disadvantageous since the device is bulky for the patient to carry around and the patient must further separately carry the marking devices to place on the recording grid.

Therefore, a primary objective of the present invention is the provision of a novel and improved means for recording periodic medicinal dosages.

Another objective of the present invention is the provision of a means for recording periodic medicinal dosages which is portable and convenient for a patient to carry.

Another objective of the present invention is the provision of a means for recording periodic medicinal dosages which is self contained and does not require the patient to carry around additional buttons or markers.

A further objective of the present invention is the provision of a means for recording periodic medicinal dosages which is accurate, durable, and economical to manufacture.

These and other objectives will be apparent from the following description of the invention.

SUMMARY OF THE INVENTION

The medicinal recording device of the present invention is used to remind patients when to take their medications and of whether a particular dose of medication has already been taken. The device can further be used by health care practitioners to monitor patient compliance with their medication. The device may be placed directly upon the patient's prescription bottle, tube, etc. or may be separate. The device consists one or more strips having several marked buttons. The buttons protrude from the strip and can be provided with various indicia, including numbers or letters corresponding with the days of the week. A sliding tab having a window is operably attached to each strip in such a manner so it can be moved up and down the length of the strip to highlight a particular marked button. The sliding tab is designed to remain in place over a particular button until it is time for the patient to take another dose of medication and move the tab to another extruded button.

In an alternative embodiment of the invention, marked detents are provided in the strip rather than protruding from the strip. In this embodiment, the strip has cut-out portions around each of the buttons so that the markings on the buttons can be easily seen.

In practice, after taking a dose of medication, the patient moves the sliding tab to the marked button indicating the number of the dose taken. If it is the first dose of the day, the patient could also move a sliding tab connected to another strip having buttons to mark the day of the week the medication is taken. If the medication is taken more than once a day, at the next dosing time the patient would move the sliding tab to the next dosing number, and so forth.

The medicinal recording device can be manufactured in a variety of materials and include different numbers of marked buttons corresponding to the frequency of dosing, such as once a day, twice a day, every other day, etc.

DETAILED DESCRIPTION OF THE INVENTION

Figure 1:
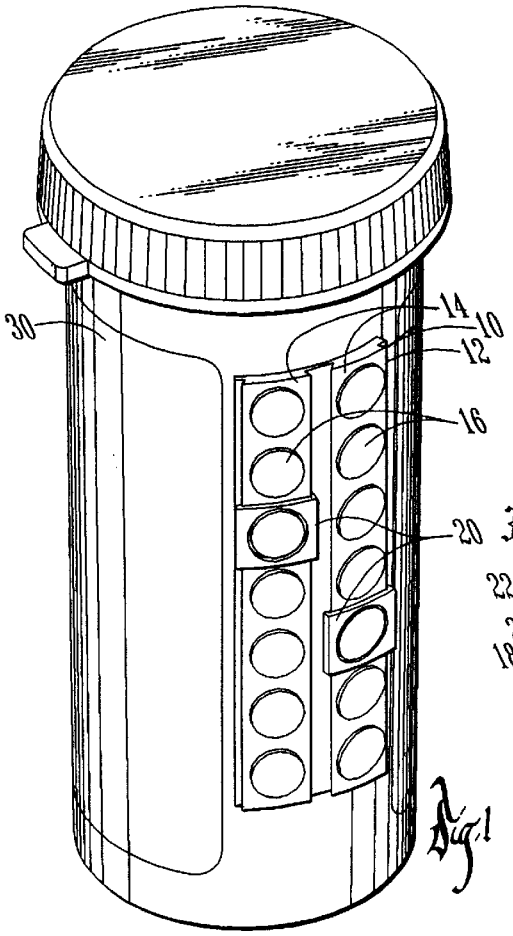
FIG. 1 is a perspective view of a prescription bottle with the medicinal recording device of the present invention.
Figure 2:
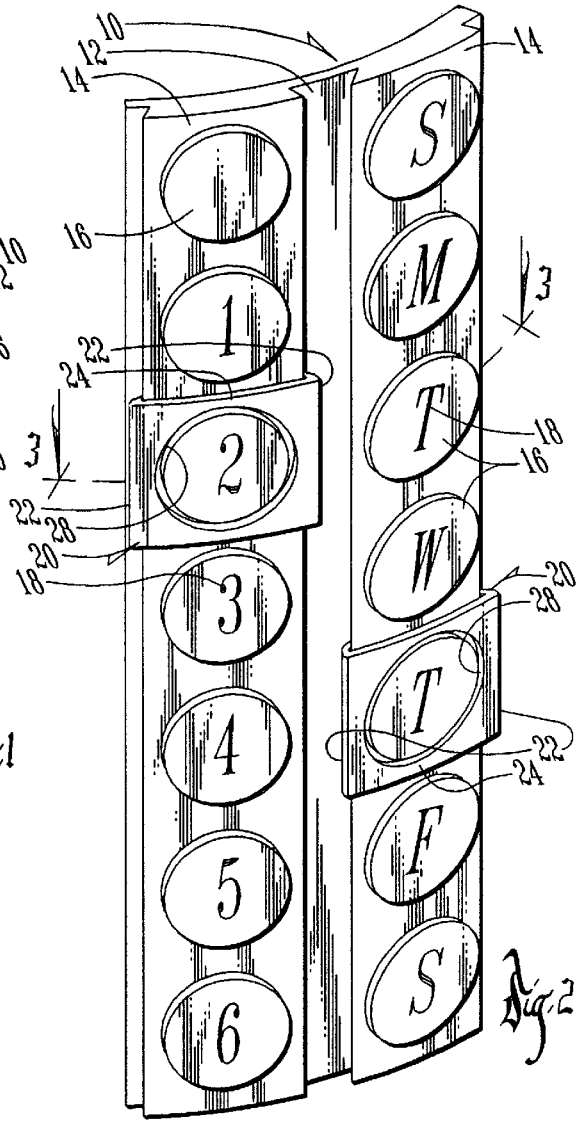
FIG. 2 is a perspective view of a preferred embodiment of the medicinal recording device of the present invention.
Figure 4:
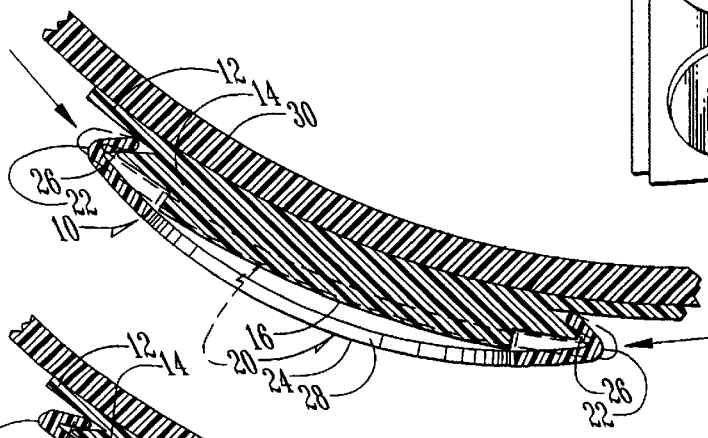
FIG. 4 is an enlarged partial cross sectional view of the left strip of FIG. 3, showing the sliding tab when engaged with a button (solid lines) and when disengaged (broken lines).

A preferred embodiment of the medicinal recording device of the present invention is shown in FIGS. 1–4. The medicinal recording device 10 generally comprises a panel 12 which is shown placed on a prescription vial 30. The panel 12 comprises two vertically placed strips 14 with each strip 14 having buttons 16. The strips may be integral, as shown in FIG. 2, or separate from one another. The buttons 16 can be of any shape, but round is preferred for ease of manufacturing. The buttons 16 can be marked with several types of indicia 18, such as the days of the week or numbers as shown in FIG. 2. The indicia 18 can also be in Braille for blind patients. Other types of marking indicia 18 can also be used, such as times or dates.

A sliding tab 20 having opposite ends 22 and a middle section 24 is operably attached to each strip 14 so that the tab 20 can slide vertically up and down the strip 14. The opposite ends 22 each have a lip 26 which folds inwardly to secure the tab 20 to strip 14. The sliding tab 20 must fit snugly around the button 16 and strip 14 so that the tab 20 does not slide from position when placed on a button 16 until the patient wants to move it. The sliding tab 20 has a cut-out window portion 28 which is large enough so that the patient can read the indicia 18 on the buttons 16. The window 28 is preferably the same shape as the button 16. Thus, the tab 20 will not accidentally be slid or moved to an inaccurate position. Rather, the tab 20 will move only when squeezed by the user.

The sliding tab 20 is moved from one button 16 to the next by squeezing the opposite ends 22 of the sliding tab 20 together or inwardly. This causes the middle section 24 of the tab 20 to bow outwardly as shown in solid lines in FIG. 4. This bowing disengages the middle section 24 of the tab 20 from the button 16, allowing the patient to slide the tab 20 along the strip 14 to another button 16.

Figure 3:
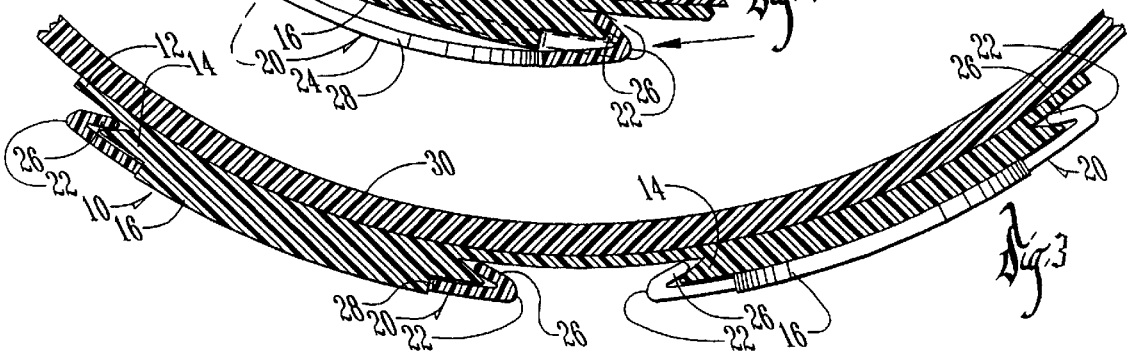
FIG. 3 is a cross sectional view of the medicinal recording device as attached to a prescription bottle taken along lines 3—3 of FIG. 2.

FIG. 3 illustrates the various layers of the medicinal recording device 10, including the medication vial 30 and the panel 12 attached to the vial 30. The panel 12 is preferably attached to the vial 30 or other medication container with an adhesive backing. However, those in the art can readily appreciate other means of attaching the panel 12 to the vial 30, including glue, tape, etc. The strip 14 is placed on the panel 12 with the marked buttons 16 being the outermost layer. The buttons 16 and strip 14 are preferably manufactured as a single piece but the buttons 16 can also be attached to the strip 14 separately. Further, the medicinal recording system 10 can also function without the panel 12. Instead, the strip 14 with its marked buttons 16 can be placed directly on the medicinal container with adhesive backing or other fastening devices.

Figures 5, 6, 7, 8, 9:
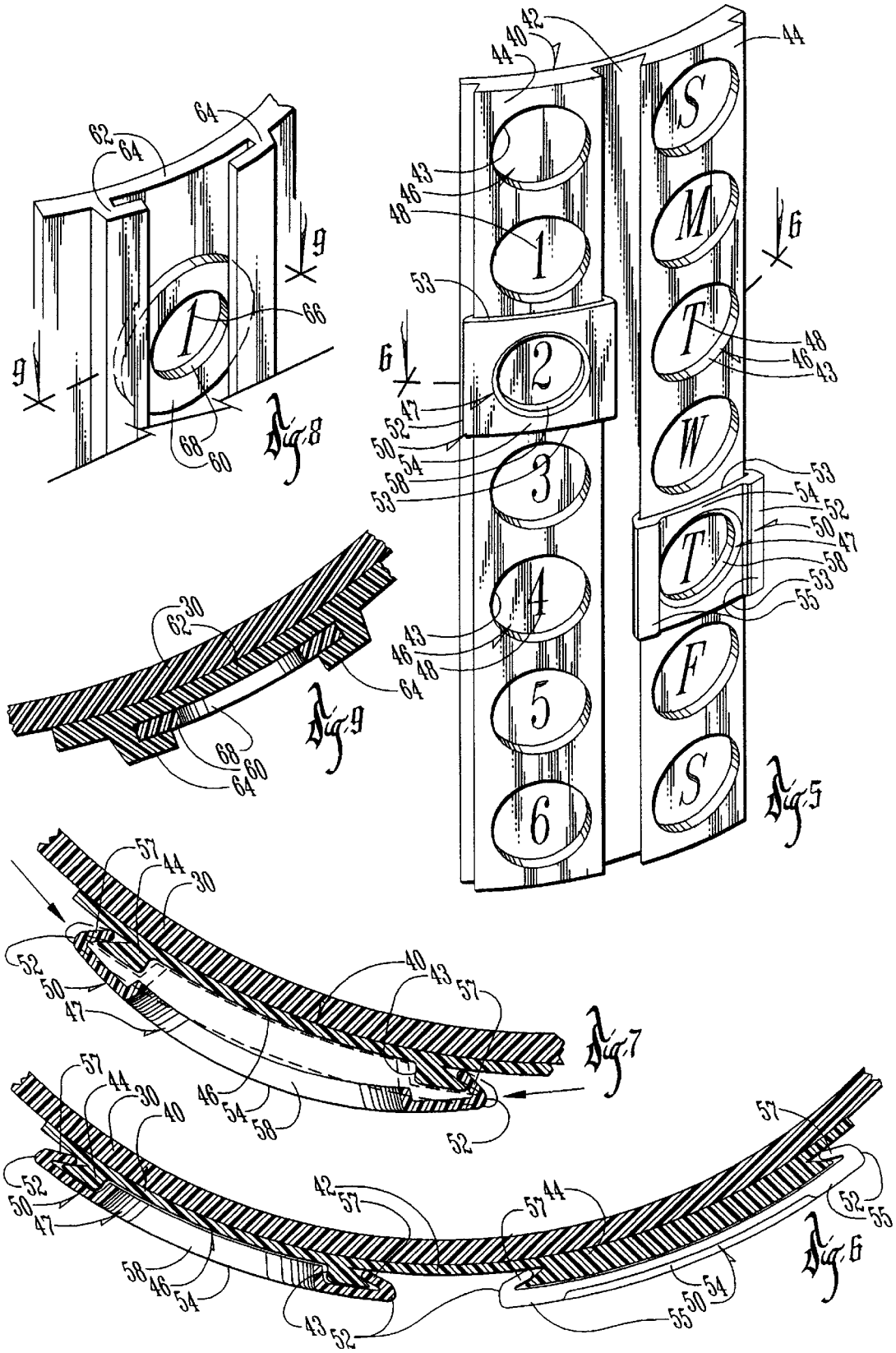
FIG. 5 is a perspective view of an alternative embodiment of the medicinal recording device of the present invention.
FIG. 6 is a cross sectional view of the alternative embodiment of the medicinal recording device as attached to a prescription bottle taken along lines 6—6 of FIG. 5.
FIG. 7 is an enlarged partial cross sectional view of the left strip of FIG. 6, showing the sliding tab when engaged with a button (solid lines) and when disengaged (broken lines).
FIG. 8 is a perspective view of yet another embodiment.
FIG. 9 is a section view taken along lines 9—9 of FIG. 8.

An alternative embodiment of the medicinal recording device 40 of the present invention is shown in FIGS. 5–7. In this embodiment, the detents 46 are provided in the strip 44. The sliding tab 50, having vertical ends 52, horizontal ends 53 and a middle section 54 is operably attached to each strip 44 so that the tab 50 can slide vertically up and down the strip 44. The opposite ends 52 each have a lip 57 which around the strip 44 to secure the tab 50 to strip 44. The sliding tab 50 has a window portion 47 with an inside "pane" 58 which extends downwardly until it seats in detent 46.

In the alternative embodiment 40, the sliding tab 50 is moved from one detent 46 to the next by either squeezing vertical ends 52 or horizontal ends 53 inwardly. This causes the middle section 54 of the tab 50 to bow outwardly as shown in solid lines in FIG. 7. This bowing disengages the middle section 54 of the tab 50 from the detent 46, allowing the patient to slide the tab 50 to another button 46, thus providing a safety feature preventing accidental movement, as with the first embodiment. FIG. 6 illustrates the various layers of alternative embodiment 40.

As a further alternative, additional raised grip enhancement tabs or surfaces 55 can be provided on the sides of the tab 50, as seen in FIGS. 5 and 6, to make movement of the tab easier.

FIGS. 8 and 9 show yet another embodiment wherein a tab 60 slides within a track 62. The track includes opposite sides with retaining flanges 64 which extend over the tab 60 to keep the tab within the track. The track includes a plurality of indicia 66 over which the tab 60 is positioned to indicate dosages. The indicia are visible through an opening or window 68 in the tab 60. The tab 60 and indicia may be detented or raised one with respect to the other, as in the first two embodiments, to assure interlocking positioning without accidental movement of the tab.

The parts of the medicinal recording device 10 can be manufactured from a variety of materials, including paper, cardboard, and plastic. The material is preferably lightweight and inexpensive. Cardboard is preferred since it is inexpensive, yet somewhat rigid which makes it easier for the patient to maneuver the sliding tab 20. The medicinal recording system 10 can be easily placed on nearly any type of medicinal container, including vials, ointment tubes, bottles, jars, and boxes. The medicinal recording system 10 is extremely compact, and therefore can be placed on smaller-sized medicine containers. Alternatively, the device 10 can be placed on a card or otherwise be separate from the bottle, particularly small bottles.

The pharmacist or patient can determine how many strips 14 should appropriately be placed on the medicine container. In a preferred embodiment as shown in FIGS. 1 and 2, the vial 30 has two strips 14 next to each other on an empty portion of the vial 30. One strip 14 has numbered indicia 18 on the buttons 16 for indicating the number of doses of medication taken and the other strip 14 has lettered buttons 16, indicating the day of the week the medication was taken. If the medication container is smaller, however, then only one strip 14 could be used or more strips 14 can be used if the container is larger-sized.

The medicinal recording device of the present invention offers many advantages over prior art medicinal recording systems. As stated above, the labels can be inexpensively made of such materials as paper, plastic, etc. Thus, they can be economically used by pharmacists or physicians without adding a significant amount of cost to the medication packaging. Further, the recording system is placeable directly on the medication container, thus alleviating the need for the patient to carry a separate and bulky medication box. Moreover, since the recording system is entirely self-contained, the patient is not required to carry around separate buttons or stickers. Also, the recording system is reusable and can be removed and placed on other medication containers.

Most importantly, the patient and health care provider will have a convenient, accessible method for keeping track of medication dosing. Since the device is applied directly to the medication packaging, the patient is easily reminded of when the next dose of the medication is due and whether the previous dose has already been taken to help prevent double dosing.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method for recording the periodic consumption of medicinal pills, the pills being contained in a pill bottle having a sidewall, the method comprising:

providing two strips having a plurality of indicia on the sidewall of the bottle, the indicia on the first strip corresponding to days of the week, and the indicia on the second strip corresponding to a number of dosages to be taken per day;

sliding a first tab each day along the first strip to one of the indicia, the indicia corresponding to a particular day;

sliding a second tab along the second strip to one of the indicia each time a dosage of pills is consumed, the indicia corresponding to a particular dosage;

engaging the first and second tabs in a substantially locked position corresponding to one of the respective indicia; and squeezing the ends of the tabs inwardly to cause the tabs to release from the locked position prior to the step of sliding the tabs along the strips.

2. A method according to claim 1 further comprising unlocking the tab by squeezing opposite sides of the tab so as to permit sliding of the tab to a different position.

3. A method for recording the periodic consumption of medicinal pills, the pills being contained in a pill bottle having a sidewall, the method comprising:

providing two strips having a plurality of indicia on the sidewall of the bottle, the indicia on the first strip corresponding to days of the week, and the indicia on the second strip corresponding to a number of dosages to be taken per day;

sliding a first tab each day along the first strip to one of the indicia, the indicia corresponding to a particular day;

sliding a second tab along the second strip to one of the indicia each time a dosage of pills is consumed, the indicia corresponding to a particular dosage; and unlocking the tab by squeezing opposite sides of the tab so as to permit sliding of the tab to a different position.

4. The method of claim 3, further comprising:

mechanically locking each tab in a selected position to prevent unintentional sliding of the tabs along the strips.

5. A method according to claim 3 further comprising engaging the tab in a substantially locked position corresponding to one of the indicia.

6. A method according to claim 5 further including the step of:

squeezing the ends of the tab inwardly to cause the tab to release from the locked position prior to the step of sliding the tab along the strip.

7. A medicinal recording device comprising:

a strip;

a plurality of recessed detents on the strip;

a plurality of dosage indicia provided on the recessed detents;

a tab operably attached to the strip such that the tab can slide up and down the length of the strip, said tab having opposite ends; and the tab including a lip adapted to extend into each detent to secure the tab in position.

8. A medicinal recording device, comprising:

a first strip and a second strip;

a plurality of raised buttons on the strips;

a plurality of dosage indicia provided on the raised buttons;

the indicia on the first strip corresponding to days of the week and the indicia on the second strip corresponding to a number of dosages of medication to be taken per day; and first and second tabs operatively attached to the first and second strips, respectively, such that the tabs can slide up and down the length of the strips, said tabs having opposite ends.

9. A medicinal recording device according to claim 8 wherein the strip is on a panel having adhesive backing for attachment to a pill bottle.

10. A medicinal recording device according to claim 9 wherein the strip and panel are integrally formed.

11. A medicinal recording device according to claim 8, further comprising:

an adhesive backing on the strip such that the strip is adapted to adhere to a sidewall of a pill bottle.

12. A medicinal recording device according to claim 8 wherein the tab has a window of a size large enough such that the indicia can be seen through the window.

13. A medicinal recording device according to claim 8 wherein each button is adapted to extend into an opening in the tab so as to secure the tab in position.

14. A medicinal recording device according to claim 8 wherein the tab is engageable with the strip adjacent each indicia so as to be releasably locked in position at a selected indicia.

15. A medicinal recording device according to claim 8 wherein the recording device comprises at least two strips.

16. A medicinal recording device according to claim 8 wherein the opposite ends of the tab terminate in lips folding inwardly to securely fasten the tab around the strip.

17. A medicinal recording device according to claim 8 wherein the tabs are resilient.

18. A medicinal recording device, comprising:

a first strip and a second strip;

a plurality of recessed detents on the strips;

a plurality of dosage indicia provided on the recessed detents;

the indicia on the first strip corresponding to days of the week and the indicia on the second strip corresponding to a number of dosages of medication to be taken per day; and first and second tabs operatively attached to the first and second strips, respectively, such that the tabs can slide up and down the length of the strips, said tabs having opposite ends.

19. A medicinal recording device according to claim 18 wherein the tab is engageable with the strip adjacent each indicia so as to be releasably locked in position at a selected indicia.

20. A medicinal recording device according to claim 18 wherein the opposite ends of the tab terminate in lips folding inwardly to securely fasten the tab around the strip.

21. A medicinal recording device according to claim 18, further comprising:

an adhesive backing on the strip such that the strip is adapted to adhere to a sidewall of a pill bottle.

* * * * *